US006163020A

United States Patent [19]

Bartusch et al.

[11] Patent Number: 6,163,020

[45] Date of Patent: Dec. 19, 2000

[54] FURNACE FOR THE HIGH-TEMPERATURE PROCESSING OF MATERIALS WITH A LOW DIELECTRIC LOSS FACTOR

[75] Inventors: Wolfgang Bartusch, Leonberg; Günter Müller, Rudersberg, both of Germany

[73] Assignee: GERO Hochtemperaturoefen GmbH, Germany

[21] Appl. No.: 09/341,175

[22] PCT Filed: Jan. 2, 1998

[86] PCT No.: PCT/EP98/00003

§ 371 Date: Aug. 12, 1999

§ 102(e) Date: Aug. 12, 1999

[87] PCT Pub. No.: WO98/30068

PCT Pub. Date: Jul. 9, 1998

[30] Foreign Application Priority Data

Jan. 4, 1997 [DE] Germany ..... 197 00 141

[51] Int. Cl.[7] ..... H05B 6/70

[52] U.S. Cl. ..... 219/756; 746/759; 746/762

[58] Field of Search ..... 219/756, 759, 219/745, 746, 762, 748, 750

[56] References Cited

U.S. PATENT DOCUMENTS

| | | | |
|---|---|---|---|
| 4,307,277 | 12/1981 | Maeda et al. | 219/756 |
| 5,449,887 | 9/1995 | Holcome | 219/756 |

FOREIGN PATENT DOCUMENTS

| | | |
|---|---|---|
| 0 178 217 | 4/1986 | European Pat. Off. . |
| 0 500 252 | 8/1992 | European Pat. Off. . |
| 42 00 101 | 7/1993 | Germany . |
| 196 33 245 | 11/1997 | Germany . |
| WO 95/05058 | 2/1995 | WIPO . |

*Primary Examiner*—Philip H. Leung
*Attorney, Agent, or Firm*—Pendorf & Cutliff

[57] ABSTRACT

In the furnace (10) for the high-temperature processing of materials with a relatively low dielectric loss factor (tan δ) by heating the material by absorption of microwave energy in a resonant cavity (16), a uniform energy intensity of the microwave field is to be achieved for example by irradiating the microwave energy over a broad band and/or by varying in time the frequency of the irradiated microwave energy. The resonant cavity (16) and the radiation source (13) are tuned to each other such that the relation: $(V/\lambda^3)$. $B \geqq 20$ is satisfied. V stands for the volume of the resonant cavity (16), λ for the wavelength of the microwave radiation and B its band width. $V/\lambda^3$ equals at least 300 and the clear dimensions 1x, ly and lz of the resonant cavity (16) in the direction of the co-ordinates x, y and z are approximately equal to the cubic root of V. The wall $(\mathbf{16}_1$ to $\mathbf{16}_6)$ of the resonant cavity is made of graphite and can be heated by a heating device (28) up to the temperature of the material to be treated. The heating device is arranged outside the resonant cavity, and a heat insulting envelope (38) encloses the unit of resonant cavity (16) and heating device.

28 Claims, 3 Drawing Sheets

Figure 1:
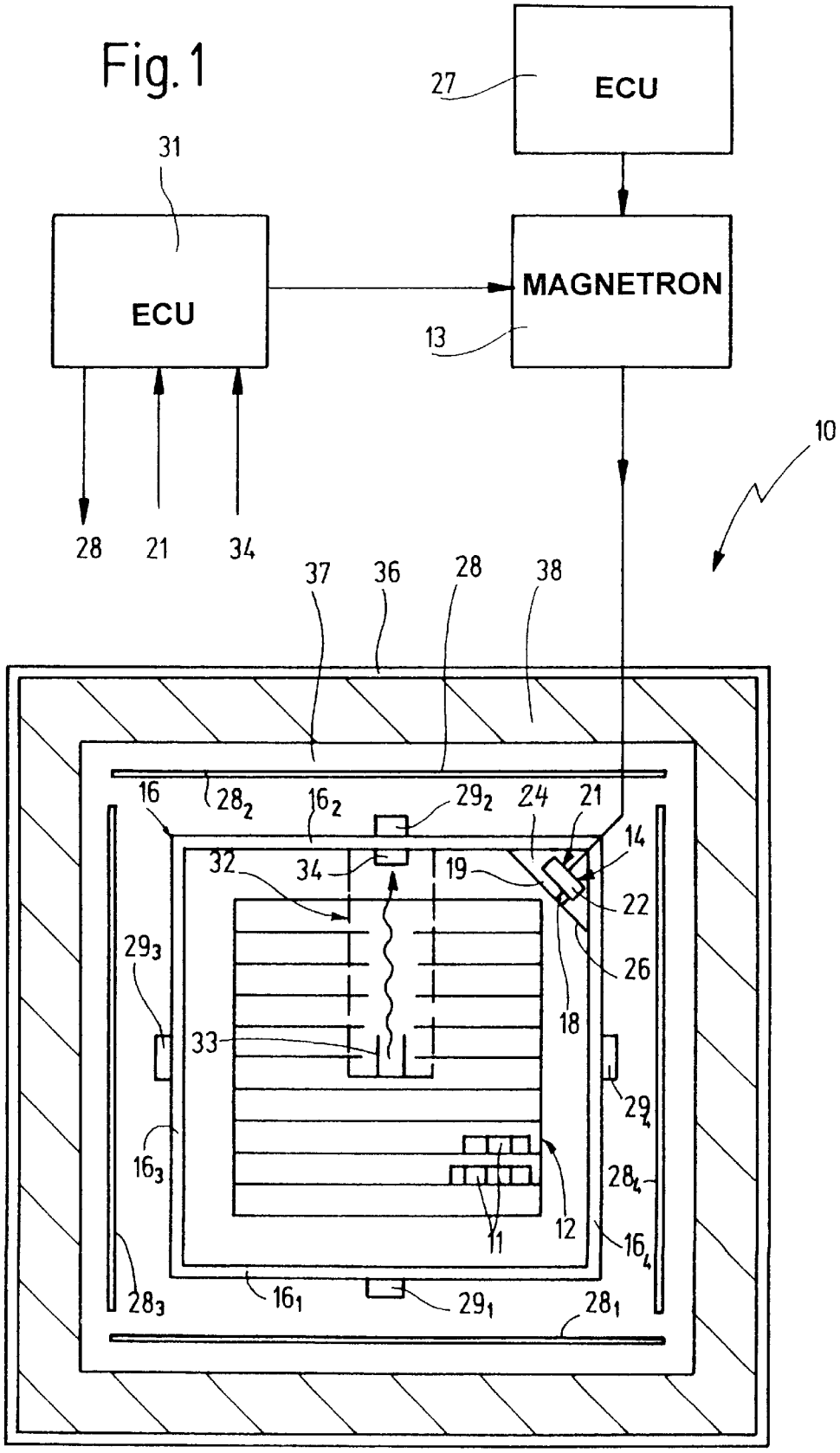

FURNACE FOR THE HIGH-TEMPERATURE PROCESSING OF MATERIALS WITH A LOW DIELECTRIC LOSS FACTOR

DESCRIPTION

The invention concerns a furnace for the high-temperature processing of materials with a relatively low dielectric loss factor, wherein the materials are heated by absorption of microwave energy in a resonant cavity.

A furnace of this type is known from WO95/05058 PCT/GB94/01730.

This known furnace has a design that is suitable for sintering ceramic materials which rest in a pile or heap within a cuboidal resonant cavity during sintering, within which cavity an again somewhat cuboidal space for the batch is bordered by a cuboid shaped heat insulator arrangement, which corresponds to the area or space within the resonator, within which it is presumed that a sufficiently homogeneous distribution of the electric field strength occurs. The uniformity of the electric field strength or, as the case may be, the cubic shape thereof is a precondition therefor, that the sinterable material is sufficiently "uniformly" thermally treatable. In order to be able to counter the effect, that with increasing warming of the sinterable material the radiation of heat from the outer areas of the sinter batch leads thereto, that on the inside of the batch a higher temperature exists than in the mentioned outer areas, an effect which is characteristic for microwave baking ovens, a device is provided, which makes it possible to conventionally warm the outer areas of the batch being sintered, that is, supplementation by means of a resistance heater, in order in this manner to achieve an equalization of the temperature profile within the entire batch of material being sintered.

The known furnace may be suitable for producing approximately homogeneous thermal conditions in the overall volume of material being processed, however in the case of relatively small processing volumes it is associated with the disadvantage that the thermal insulator arrangement, which is subjected to the microwave radiation, absorbs a major portion of the introduced microwave energy, which necessarily leads to a high consumption of microwave energy, which is not available for the desired thermal treatment of the material being sintered. This can be seen from the fact that, in practice, the total volume of the insulator material is significantly larger than the volume of the material being sintered. The known furnace is thus not suitable as an industrially useful furnace, since there is no efficient utilization of the microwave energy, of which the cost of production is however much higher than in the case of "conventional" heating by means of an electrical resistance heater.

While a furnace designed as a continuous heating or pusher-type furnace may be known from WO95/05058, which is designed as a tunnel oven with heating zones of various temperatures, through which the material being sintered is transported over transport rolls, wherein the supplemental heating means is arranged or provided outside of the treatment chamber and in which the thermal insulation, which insulates the surroundings against the high-temperature zone, surrounds the oven from the outside. In the case of this oven however the arrangement necessarily results in insufficient field homogeneity, that is, this oven design is only useful because relatively small objects are sintered serially and since there is a continuous movement through the non-homogeneous areas, thus there is no requirement for a homogeneous field distribution.

The known tunnel oven may be suitable for materials with high dielectric loss, which strongly absorb microwave energy, but it is however not suitable for treatment or processing of materials to be sintered with relatively weak dielectric losses, which can be processed practically only in significant numbers of pieces in a resonant cavity with high field homogeneity.

The known tubular oven would not be suitable for materials with low dielectric loss factor, which technically however are also of high interest.

It is thus the task of the invention, to provide a furnace of the above described type, which enables a high-temperature treatment of low dielectric loss factor sinterable materials with in a large processing volumes, which on the basis of its dimensions can be employed as an industrial oven and thereby at the same time is operable with a high degree of efficiency of energy utilization. Further, the furnace should be suitable for utilization within a wide temperature range up to 1800° C.

This task is solved by the present invention.

The desired functional characteristics and advantages of the inventive furnace are at least the following:

By adhering to the dimensional relationships according to characteristic a) there results with respect to the outer dimensions of the resonator a suitable homogeneity of the field distribution for a large processing volume, within which a large number of evenly distributed or loaded sinterable objects can be treated.

By the positioning of the insulator material towards the outside it is ensured, that the major portion of the produced microwave radiation can be used for the respective given processing requirements. Thereby an economical operation of the inventive oven as an industrial oven is made possible.

By the employment or utilization of graphite as the wall or lining material for the resonant cavity it is not only possible to drastically increase the temperature range within which the high-temperature processing of sinterable material is possible, but rather it is also, in comparison to the conventional resonant cavity constructed of steel, to reduce the weight thereof and therewith the wattage or heat generation energy requirement of the supplemental electric heater device, which is necessary for the establishment of the desired temperature profile. This also contributes to the economic efficiency of the operation of the inventive furnace when designed as an industrial oven.

In the preferred design of the furnace, there is employed as microwave radiation source at least a magnetron, which is tunable about a center frequency within a band width B, which is characterized by the equation $B=\Delta f/f$, in which the frequency band is indicated by $\Delta f$, of a approximately $1/100$.

Such a magnetron can have a center frequency of, for example, 2.45 GHz, which corresponds to a tuning range of from 2.438 GHz to 2.462 GHz.

Thereby a large number of modes of oscillation can be excited or stimulated in the resonant cavity, which, by tuning the magnetron between the border frequencies, can be stimulated or induced at intervals sequentially one after the other.

The advantageous result thereof is that at various times various spatial distributions of the field strength occur, which taken over time produce a substantially homogeneous field in the processing area.

In a useful embodiment the radiation source is so constructed, that the time for the frequency modulation between the border frequencies lies in a range of tenths of a second, that is between 0.05 and 1 second, that is, within a time span, which is small in comparison to the thermal relaxation time of the material being sintered.

This step is advantageous, in order to avoid thermal tensions within the material being sintered. This type of tension can build up when, as a consequence of too-small a rate-of-change the frequency distribution which is characteristic of a particular frequency, and which is necessarily non-homogeneous, is maintained for too long a period of time.

In the sense of an effective broadening of the frequency band, within which the resonant cavity is excitable, it can also be of advantage, when a number n of magnetrons are provided as microwave radiation sources, which are operable at various center frequencies $f_i$ (i=1 through n) and are tunable within their respective frequency band $\Delta f_i$.

A quasi-continuous "seamless" tuning range of the frequency results, when the frequency separation of the center frequencies of the magnetrons which are next to each other in the frequency scale satisfy the equation $(\Delta f_i+\Delta f_{i+i})/2$.

In the preferred embodiment of the furnace the resonant cavity has a cuboidal design, preferably such that the edge lengths $1_x$, $1_y$ and $1_z$ of the resonant cavity boundary correspond at least to the 10-fold of the wavelength $\lambda$ of the microwave radiation.

Alternatively thereto the resonator cavity can, as provided in claim 7, when viewed in the direction in which the planar boundary walls of the resonator chamber intersect each other along parallel corner edges, have a polygonal shape, that is the shape of a prismatic chamber profile. In this design the resonator can be assembled in a simple manner of plate-shaped elements, particularly also, as set forth in claim 8, of plate-shaped graphite material.

This design of the resonator cavity has the advantage, that the furnace can be operated at very high temperatures, so that sinter processes are possible in the temperature range of up to 1800° C.

In the case of a multi-sided polygonality and, in certain cases, regular polygonal design of the resonator cavity it is also possible to approach with good approximation a cylindrical tubular-shaped resonator.

This design has the advantage, when viewed from the perspective of construction, that the constructed shape of the resonator can better approximate the shape of a conventionally cylindrical outer container, which can be evacuated and/or be flooded or flushed with inert gas.

In order to introduce the high microwave power necessary for sintering the sinterable material woth a homogeneous spatial distribution in the resonator cavity, it is advantageous to select an antenna arrangement, which in accordance with claim 9 has an omni-directional radiation characteristic, that is, avoids a specific direction of radiation. An antenna of this type is designed, in accordance with the characteristics set forth in claim 10, as a group emitter comprising multiple individual emitters, of which the individual emitters can be supplied in a statically distributed phase position.

Such a group emitter is designed, in a preferred embodiment of the oven, as a slit emitter in accordance with claim 11, which includes a plurality of radiation slits with a slit length of between $\lambda/4$ and $\lambda/2$ and, in comparison thereto, a small slit width w, which viewed in the direction of radiation of the microwave field in the source wave guide, are distributed over the length thereof in such a manner, that per slit the same or approximately similar amounts of microwave energy can be introduced into the resonant cavity, whereby, viewed in the direction of radiation of the microwave field in the wave guide, the extension of the individual slits corresponds to between w and $\lambda/2$, of which further in the direction of radiation of the microwave field in the wave guide measured distance sequential slits of the slit antenna have a value of between $\lambda/2$ and $3\lambda/4$ and, with respect to the center plane of the wave guide, running in the direction of radiation, the sideways separation of the slits from this center plane, over the length of the wave guide, increases stepwise, and the statistic distribution of the longitudinal slits, which form the individual radiation elements, is provided with reference to the longitudinal center plane of the wave guide.

In this design of the slit antenna, a very good omni-directional radiation characteristic is achieved already when at least 20 individual slits are provided, wherein with increasing number of slits an always more effective approximation of the antenna characteristic of an omni-directional characteristic is achieved.

In the special design of the slit emitter as described in accordance with claim 13, at least some of its slits can run perpendicular to the direction of propagation or expansion of the microwave field in the wave guide.

In consideration of an even energy introduction in the resonant chamber, it can also be of advantage when multiple group emitters of the above described type are provided, as a result of which a statistically more even distribution of the phase positions of the microwave energy introduced over the individual antenna elements can be achieved and on the other hand also a correspondingly increased energy input is possible, which is appropriate for the heating of a large-volumed batch of sinterable material.

Both for construction reasons as well as reasons of radiation characteristics ("horn"-effect of the resonator walls) it can be particularly advantageous, when the antenna (s) are provided in strip-shaped edge areas of planar parts of the resonator wall, which run immediately adjacent to corners of the resonator walls along which the resonator inner surfaces join with each other.

The supplemental heater, which surrounds the resonator and/or the wave guides, via which the antenna(s) are supplied, is designed as an electrically controllable resistance heater, which is controlled in accordance with a preprogrammed temperature profile, which is designed to correspond to the temperature sequence in the material being sintered, which for its part is monitored by a temperature sensor, preferably a pyrometer, and is utilized for comparing the actual and intended values for the heating of the resonator wall, of which the temperature is compared with the temperature of the material being sintered in the sense of a follow-up control, which is essentially controlled or determined by the microwave power radiated in.

Herein it is advantageous, that temperature sensors are provided for various wall areas of the resonator, by means of which the, in certain cases, varying resonator wall temperatures, can be sensed, and that the heating of the individually monitored wall areas involves associated heating elements, which for their part are individually controllable, wherein it is advantageous in the case of a cuboid-shaped resonator to provide for each resonator wall an individual heater element and an individual temperature sensor.

In the positioning of the thermal insulator outside of the resonator cavity and also outside of the heating element in accordance with the invention, the insulator material itself can be formed of a material based on graphite, for example graphite felt, which then prevents, presuming it is positioned on the inside of the housing surrounding the resonator, on the basis of the conductivity of the graphite material, an effective suppression of any microwave radiation emission towards the outside.

Figure 2:
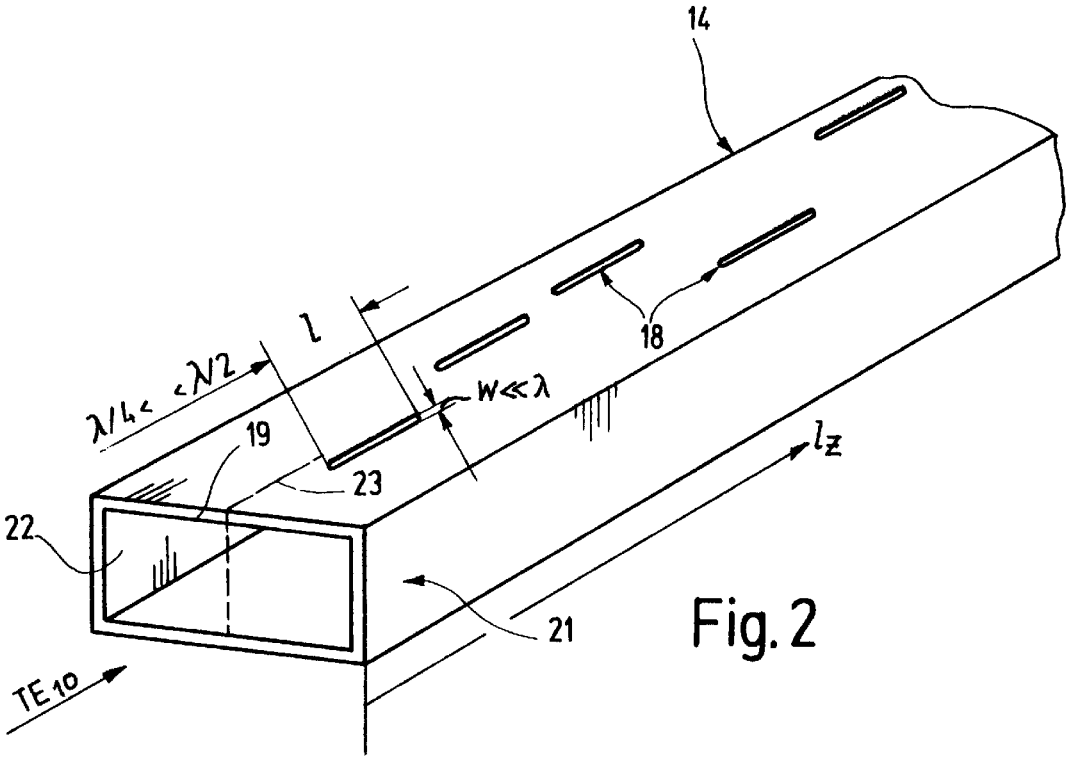
Figure 2A:
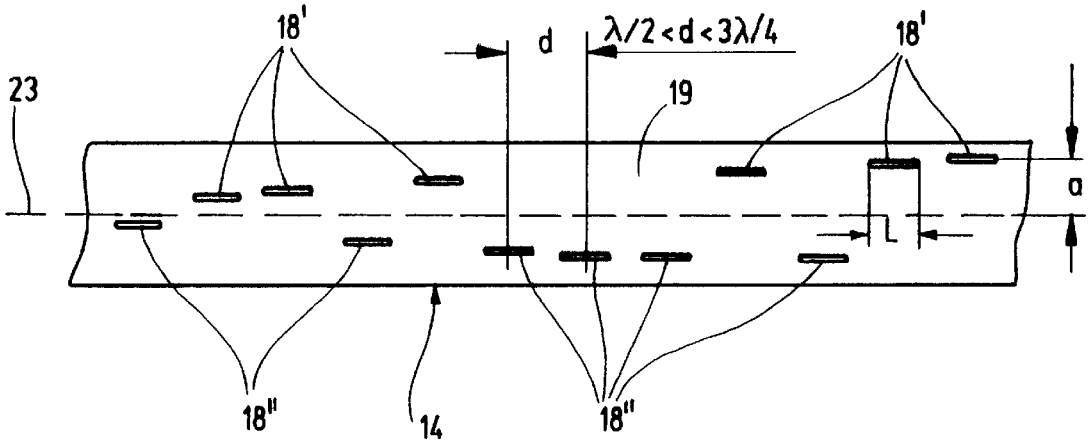

Further details of the inventive furnace can be seen from the following description of a special embodiment of the invention and possible variations of the same on the basis of the drawings. There are shown in FIG. 1 an illustrative embodiment of an inventive furnace for the high-temperature processing of sinterable ceramic materials with low dielectric loss factor, which are heatable within the cuboidal shaped resonant cavity of the furnace by absorption of microwave energy, in schematically simplified diagrammatic representation, FIG. 1*a* a simplified diagramatic perspective view of the resonator cavity and the arrangement of the processing tolerances;

FIG. 2 details of a slit antenna device for introduction of microwave energy into the resonator cavity of the furnace according FIG. 1, in schematic simplified, partially broken-away perspective representation and FIG. 2*a* the slit antenna according to FIG. 2 in simplified top view.

The furnace indicated overall with 10 in FIG. 1 is intended for the thermal processing, in particular sintering, of essentially schematically represented work pieces 11, which achieve material characteristics required in finished work pieces for predetermined applications and/or spatial dimensions only as a consequence of this thermal processing.

Typical work pieces 11, which are produced on the basis of nitride-ceramic material, in particular $Si_3N_4$, such as ball-bearing housings, valve bodies and housings, and nozzles, or which can be produced on the basis of ceramic oxide materials, for example, sealing discs and rings, and which require a sintering processing, can be exposed to this thermal treatment in the furnace 10.

These are materials with a relatively low dielectric loss factor (tan $\delta$<0.01), which are arranged in a batch indicated overall with reference number 12.

Figure 1A:
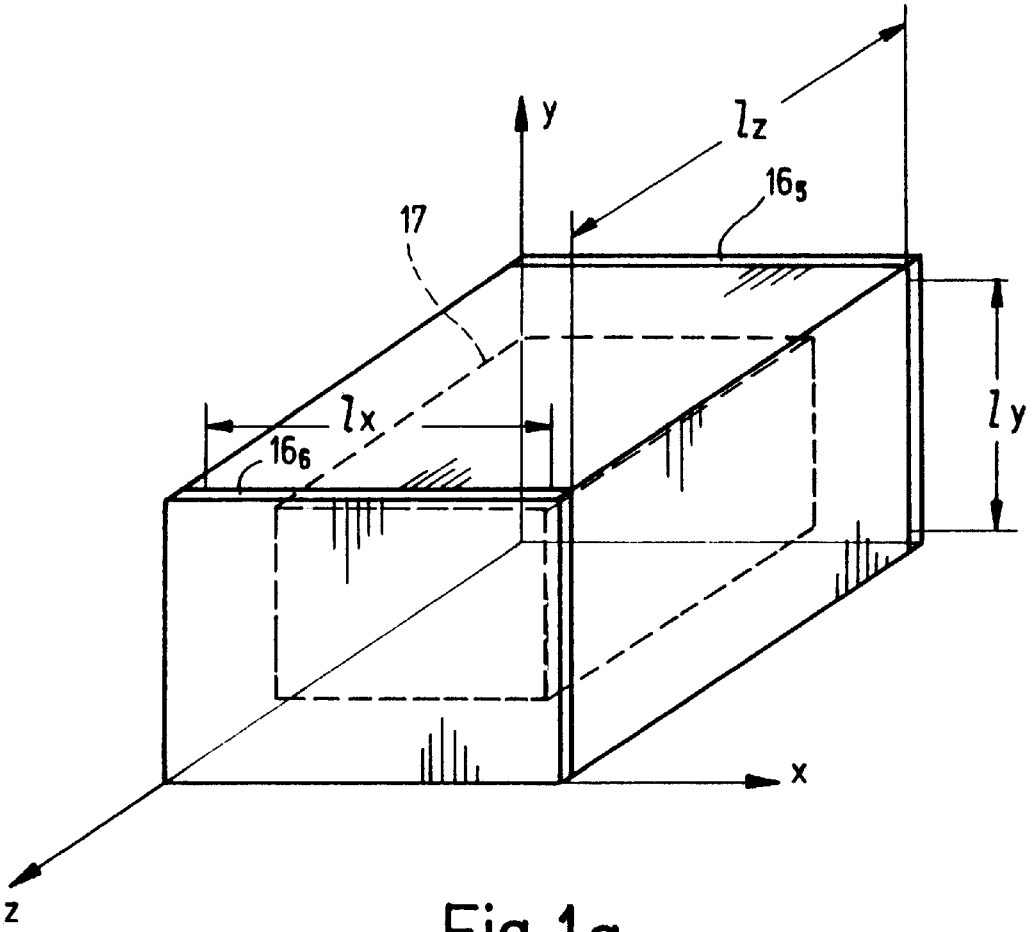

The heating of the sinterable material comprised of work pieces 11 as achieved by absorption of microwave energy, which is produced by a microwave source 13 and is fed via an antenna-arrangement generally indicated with 14 with omni-directional radiation characteristics in the inside of a resonant cavity indicated with 16 with electrically conductive walls $\mathbf{16}_1$ through $\mathbf{16}_6$, which in the shown special embodiment has the form of a cube, of which the dimensions $l_x$, $l_y$ and $l_z$ are significantly larger, that is approximately 10 times larger, than the wavelength $\lambda$ of the microwaves produced by the microwave source 13, and respectively lies in the size range of $$\sqrt[3]{\nabla}$$

wherein $V_{res}$ represents the volume of the resonant cavity ($V_{res}=l_x \cdot l_y \cdot l_z$). The processing space, within which the not individually represented sinterable material is maintained in a batch as dielectric load of the resonant cavity 16, is schematically represented in FIG. 1*a* as a central partial space 17 geometrically similar to the internal space of the resonant cavity 16, of which the useful volume for thermal treatment of the sinterable material 11 can correspond to approximately ⅓ of the resonator volume $V_{res}$.

In such a resonator 16 the resonance conditions for the wavelength of the microwave radiation, which is resonant in the resonator 16, would be as follows $$\lambda_r = \frac{2}{\sqrt{\left(\frac{m}{Lx}\right)^2 + \left(\frac{n}{Ly}\right)^2 + \left(\frac{o}{Lz}\right)^2}} \tag{1}$$

wherein m, n and o represent quantum whole values, with which the equation (1) can be satisfied.

The resonant modes which can be stimulated in such a resonator cavity produce a field distribution within the resonator chamber which periodically varies over the three coordinate directions x, y and z, wherein the square ($E^2$) of the dielectric field strength (E) of the electric field produced in the resonator cavity varies between 0 and the maximum amount, that is, a field distribution, which is spatially extremely non-homogeneous.

The homogeneous distribution of the electric field energy necessary for a qualitatively even treatment of sinterable material distributed over the processing partial space 17 can be achieved in good approximation, when the resonator cavity is stimulated or energized by a high number of resonant oscillation modes and these oscillation modes are at least temporarily superimposable or heterodyned, wherein the number $\Delta N$ of the oscillation modes which can be stimulated are determined by the equation $$\Delta N = \frac{8 \cdot \pi \cdot V_{res}}{\lambda^3} \cdot \frac{1}{Q_{total}} \tag{2}$$

in which $V_{res}$ represents the volume of the resonator cavity, $\lambda$ represents the vacuum wavelength and $Q_{total}$ represents the total Q value or quality of the previously described device 10, 11, 12, 13, 14, which for their part are characterized by the equation $$\frac{1}{Q_{total}l} = \frac{1}{Q_{res}} + \frac{1}{Q_{ant}} + \frac{1}{Q_{diel}} + \frac{1}{Q_{source}} \tag{3}$$

In this respect the quality or Q factor of the resonator is represented by $Q_{res}$, which is determined by the equation $$Q_{res} = \frac{3 \cdot V_{res}}{2 \cdot A_{res} \cdot e} \tag{4}$$

$Q_{ant}$ represents the power of the antenna-arrangement, for which the following equation applies $$Q_{ant} = \frac{8 \cdot \pi \cdot V_{res}}{A_{ant} \cdot \lambda} \tag{5}$$

$Q_{diel}$ represents the power of the sinterable dielectric material, for which the following equation applies $$Q_{diel} = \frac{V_{res}}{V_{diel}} \cdot \frac{1}{\sqrt{\varepsilon_r} \cdot \tan\delta} \tag{6}$$

and $Q_{source}$ represents the power of the microwave source (13), which is determined by the equation $$Q_{source}=1/B \tag{7}$$

In the equations (4), (5), (6) and (7) the symbols have the following meanings $A_{res}$ the total surface area of the resonator wall, e the penetration depth in the resonator wall $A_{ant}$ the emission surfaces of the antenna-arrangement 14, $V_{diel}$ the volume of the dielectric material to be processed 11, $\in_r$ the dielectric number of the sinterable material 11, tan δ the dielectric loss factor of the sinterable material and B the band width of the microwave source 13.

In the furnace 10 selected for illustration a magnetron with a base frequency of 2.45 GHz is provided as microwave emitter source 13. The resonator volume $V_{res}$ is 1.4 $m^3$, so that the relationship $V_{res}/\lambda^3$ has a value of 770. A value of 7.6 $m^3$ is assumed for the value $A_{res}$ for the total surface area of the resonator walls $\mathbf{16}_1$ through $\mathbf{16}_6$. The resonator walls $\mathbf{16}_1$ through $\mathbf{16}_6$ are comprised of a plate-shaped graphite material, so that with the given frequency of the microwave source a penetration depth e of 32 $\mu$m results, which corresponds to a power or quality of the resonator wall of approximately 8600.

For the "emitting" antenna surface area a value $A_{ant}$ of 60 $cm^2$ is presumed, which corresponds to a power $Q_{ant}$ of the antenna-arrangement of 48000. For the volume of approximately 0.03 $m^3$ occupied by the sinterable material 11 there results a value of the power $Q_{diel}$ of the sinterable material of 2100, when for the dielectric coefficient thereof a value of 8 and a loss factor of 0.008 is selected. In the operation of the magnetron 13 with a fixed frequency the band width B of the microwave radiation or emission produced by the magnetron is smaller than $10^{-6}$, which corresponds to a source power $Q_{source}$ of more than $10^6$. In the dielectric treatment of the resonator cavity with the given circumference or volume, the total power $Q_{tot}$ corresponds approximately to the power $Q_{diel}$ of the dielectric material, and the number of the oscillation modes ΔN capable of stimulation has a value of approximately 9. Therefrom it can be seen that a sufficient number of oscillation modes which are necessary for a sufficiently even distribution of the electric field in the resonator cavity can only be achieved by a broad band microwave source.

In accordance therewith the furnace 10 is so arranged, that the following equation applies $$V_{res} \cdot B/\lambda^3 \geqq 20 \quad (8)$$

The antenna device 14, by means of which the microwave energy produced by the magnetron 13 is fed into the resonator cavity 16, is formed as slit emitter, which includes a number emission slits 18, of which each forms an antenna element, of which each emitting antenna surface corresponds to the unobstructed slit surface. These emitter slits 18 are provided on a longitudinal wall 19 of a rectangular wave guide 21 which simultaneously also forms an inner wall area of the resonator cavity (FIG. 2), in which the microwave energy produced by the magnetron 13, introduced into one end of the wave guide 21 is only in the condition in the $TE_{10}$-mode (fundamental harmonic oscillation) in the shown arrangement-example to radiate in the c-direction in such a manner that the electric field vector runs perpendicular to the wave guide longitudinal wall 19 provided with the slits 18 and the field of distribution of the electric field in the internal space of the rectangular wave guide runs essentially symmetrical to the longitudinal center plane 23 thereof, which extends internally in the direction of propagation of the microwave field in the wave guide 21. These emission slits 18 are provided distributed over the length $l_c$ of the rectangular wave guide 21 in such a manner that per emission slit 18 respectively identical or approximately identical amounts of microwave energy are emitted into the resonator cavity 16, and that the phase positions of the electromagnetic fields introduced into the resonator cavity 16 by the emissions slits are varied in a statistical sequence.

Seen in the direction of propagation of the microwave field in the wave guide 21, the separation d of the sequential slits of the slit antenna 14 correspond to between λ/2 and 3λ/4 (FIG. 2*a*), wherein departing from the embodiment selected for illustration, in which the longer slit edges run parallel to the longitudinal central plane 23 of the wave guide 22, slit configurations are possible wherein slits are running with longitudinal edges diagonally thereto. In the shown configurations of the slit antenna 14, in which the emission slits run parallel to the longitudinal plane 23, the length l of the individual slits 18 is λ/4 and λ/2 and is significantly larger than the width w of the slit measured perpendicular to the longitudinal center plane 23 or as the case may be the direction of propagation of the microwave energy in the rectangular wave guide. Measured over the length of the rectangular wave guide 21, of which microwave energy produced by the magnetron 13 is introduced at one end, the sideways separation a of the emitter slits from the longitudinal center plane 23 of the rectangular wave guide 21 increase stepwise.

The sequential arrangement of the emission slits 18' and 18" provided respectively on one of the sides of the longitudinal central plane (FIG. 2*a*) correspond in the separation grid of the slit separations d, seen in the direction of propagation of the microwave field in the rectangular wave guide 21, to a "binary" random pattern of slit pairs (1,0) and (0,1), wherein (1,0) means that the slit 18' is provided in one side, the "left" side, of the longitudinal central plane 23 of the rectangular wave guide 21, however not a symmetrically thereto arranged slit 18" and the combination (0,1) means that on the other "right" side of the longitudinal central plane 23 a radiation emission slit 18" is provided, however not on the oppositely lying, "left" side. The combination (1,1), which would correspond to a phase difference of the precisely oppositely lying positioned emission radiation slits 18' and 18" radiated field of π/2, as well as the combination (0,0) are excluded from the illustrated embodiment for explanatory purposes, without limitation in practice. The slit antenna which is constructed in principle as described above works as a group emitter, of which the individual emitters formed by slits 18 or as the case may be 18' and 18" are fed with statistical varying phase position, whereby the emission characteristic of the antenna-arrangement 14 is in very good approximation to an omni-directional characteristic.

The rectangular wave guide 21 provided for supplying emission slits 18 of the antenna-arrangement 14 is, according to the schematic representation of FIG. 1, integrated in a prismatic graphite body 24, of which the outer cross-sectional contour corresponds to that of an equilateral right-angled triangle, through the hypotenuse 26 of which in the representation in FIG. 1 a resonator cavity limiting surface is represented, which in one corner area of the resonant cavity 16 communicates between the resonator walls $\mathbf{16}_2$ and $\mathbf{16}_4$ which connect with each other at right angles in the area of the antenna-arrangement 14, whereby the wave guide surfaces which border the wave guide internal space 22 run pairwise parallel or, as the case may be, perpendicular to the diagonal inner longitudinally bordering surface 26 of the resonator cavity 16, which is formed by the "hypotenuse" surface of the graphite body 24.

For increasing the number of modes of oscillation excitable within the resonator cavity, which benefits the evenness of the field distribution in the resonator cavity, to reduce "effective" quality $Q_{source}$ of the magnetron provided as an energy source a design of the magnetron 13 is provided, in which this modulation frequency is variable within a band width of 1/100 of the base frequency f of 2.45 GHz. The cycle time of the frequency variation, which is controllable by means of an electronic control unit 27, is determined by the thermal relaxation relationship of the sinterable material 11 in so far that it is small in comparison to the thermal relaxation time of the respective sinter material to be processed. In accordance therewith the electronic control unit 27 is so designed that the cycle time can amount to between 0.05 and one second.

For the purpose of a—temporal—reduction of the source power $Q_{source}$ there can also be employed the measure that multiple magnetrons are provided as microwave radiation source, which are not shown individually, which are operable at differing base frequencies fi (i=1 . . . n) and respectively have characteristic band widths $B_i$, when it then useful, when the frequency separations $\Delta f_i$ of the magnetron modulation frequencies which are adjacent to each other in the frequency scale at least satisfy the value $$\frac{\Delta f_i + \Delta f_{i+1}}{2}$$

When two or more antenna-arrangements 14 are provided for introduction of microwaves energy into the resonator cavity 16, it is useful, when these are azimuthally grouped approximately equidistant about a "central" axis parallel to the polygonal edge of the resonator cavity in order to achieve an even introduction of microwave energy into the processing or treatment chamber 17 of the resonator chamber.

The furnace 10 is provided with a heating device generally indicated with 28, which includes six electric resistance heating elements $\mathbf{28}_1$ to $\mathbf{28}_6$ corresponding to the number of the large surface wall elements $\mathbf{16}_1$ through $\mathbf{16}_6$ of the resonator cavity 16, of which the heating capacities are individually controllable, so that the temperature of the wall elements $\mathbf{16}_1$ through $\mathbf{16}_6$ can be individually influenced. The wall elements $\mathbf{16}_1$ through $\mathbf{16}_6$ are respectively provided with at least one temperature sensor $\mathbf{29}_1$ through $\mathbf{29}_6$, which produce the characteristic electric output signal for the actual value of the wall temperature.

Further there is provided a pyrometer indicated generally with 32, by means of which the temperature of the sinterable material 16 can be measured. This pyrometer 32 includes a sensor or probe body 33 provided in a suitable position in the pile or heap 12 and an electro-optic sensor 34, by means of which the emission temperature of the probe body 33 can be detected, so that a herefor characteristic electric output signal of the sensor 34 is a precise measurement for the temperature of the material being sintered. The electronic control unit 31 of the heating device 28 transmits a compared processed signal of the actual value-output signal of the pyrometer-device 32 as well as the temperature sensors $\mathbf{29}_1$ through $\mathbf{29}_6$ and transmits also a control signal for the heating elements $\mathbf{28}_1$ through $\mathbf{28}_6$ as well as the power control signal for the microwave source 13 in the sense that the wall temperature of the resonator chamber 16 overall corresponds precisely as possible to the temperature of the sinterable material 16. The sequential progress of the oven temperature, that is, both the temperature of the material being sintered as well also the resonator wall temperature(s), is controlled according to a program, which provides a qualitatively good treatment result taking into consideration the characteristics of the material and the geometric dimensions of the work pieces 11.

The resonator cavity 16 and the heating elements $\mathbf{28}_1$ through $\mathbf{28}_6$ of the heating element 28 provided for heating the walls $\mathbf{16}_1$ through $\mathbf{16}_6$ thereof are provided within a stable steel housing 36, which is constructed to be air-tight for the purpose of the possibility of an inert gas dousing of its internal space 17 inclusive of the resonator cavity, or an evacuation of the same. The steel housing 36 is covered on the inner side of the furnace 10 with a thermal insulation layer 36 for the thermal insulation of its internal space against the environment, which is comprised of a high-temperature resistant insulation material, for example graphite felt.

What is claimed is:

1. Furnace for the high-temperature processing of materials with relatively low dielectric loss factor (tan δ) by heating the material by absorption of microwave energy in a resonant cavity, in which the material to be treated is arranged within a central area of the resonant cavity, wherein a uniform energy density of the microwave field is achieved so that in each volume element of the treatment area the square of the electric field strength of the microwave field has the same value, at least over time, within a minor tolerance, wherein an electric heating device is provided, with which the resonant cavity wall can be heated to the same temperature as within the material to be treated and wherein a heat insulating envelope is provided, which insulates the furnace against heat loss into the environment, characterized by the following features:

a) the resonant cavity (16) and the radiation source (13) are sufficiently attuned to each other, so that the relation $$\frac{V}{\lambda^3} \cdot B \geq 20$$

is satisfied, wherein V is the volume of the resonant cavity (16), λ is the wavelength of the microwave radiation and B is their band width, further the amount $V/\lambda^3$ has a value of at least 300 and the transparent dimensions $1_x$, $1_y$ and $1_z$ of the resonant cavity (16) in the coordinate directions x, y and z have a value of approximately $$\sqrt[3]{V}$$

each;

b) the heating device (28) is arranged outside of the resonant cavity (16) in the immediate vicinity of the resonant wall, and the heat insulating envelope (38) is arranged so that it encompasses the resonant cavity (16) and the heating device (28) from the outside, c) the resonant wall ($\mathbf{16}_1$ through $\mathbf{16}_6$) consists of graphite or equivalent temperature maintaining and electrically conductive material.

2. Furnace according to claim 1, wherein a magnetron is provided as microwave radiation source (13), which is tunable about a basic frequency f within a band width B=Δf/f of approximately 1/100.

3. Furnace according to claim 1, wherein time intervals within which within a continuous or stepwise variation of the oscillation frequency of the microwave radiation source (13) occurs, lies between 0.05 and 1 s.

4. Furnace according to claim 3, wherein said time intervals are approximately 100 ms.

5. Furnace according to claim 1, wherein an amount n of magnetrons are provided, which are operable at various central frequencies $f_i$ (i=1 through n) and each have characteristic band widths $B_i$.

6. Furnace according to claim 5, wherein the frequency separations of the center frequencies of the magnetrons which are next to each other in the frequency scale satisfy the equation $(\Delta f_i+\Delta f_{i+i})/2$.

7. Furnace according to claim 1, wherein the resonant cavity (16) has a cuboidal design, such that the outer lengths $1_x$, $1_y$ and $1_z$ of the resonant cavity boundary correspond at least to the 10-fold of the wavelength of the microwave radiation.

8. Furnace according to claim 1, wherein the resonant cavity (16) has a polygonal cross-section.

9. Furnace according to claim 1, wherein the resonant cavity (16) is comprised of plate-shaped graphite material ($16_1$ through $16_6$).

10. Furnace according to claim 9, wherein said graphite material is plate-shaped.

11. Furnace according to claim 1, wherein for introduction of the microwave energy into the resonant cavity (16) an antenna-arrangement (14) is provided, which has an omni-directional characteristic.

12. Furnace according to claim 11, wherein the antenna-arrangement (14) is formed as a group emitter comprising multiple individual emitters, wherein the individual emitters can be supplied by a statistically distributed phase position.

13. Furnace according to claim 12, wherein the group emitter is designed as a slit emitter, which includes a plurality of radiation slits with a slit length of between $\lambda/4$ and $\lambda/2$ and, in comparison thereto, a small slit width w, which viewed in the direction of radiation of the microwave field in the feeding wave guide, are distributed in such a manner over the length thereof, that per slit the same or approximately similar amount of microwave energy can be introduced into the resonant cavity, wherein, viewed in the direction of propagation of the microwave field in the wave guide, the extension of the individual slits corresponds to between w and $\lambda/2$, of which further in the distance measured in the direction of radiation of the microwave field in the wave guide sequential slits of the slit antenna have a value of between $\lambda/2$ and $3\lambda/4$, and, with reference to the center plane of the wave guide running in the direction of propagation, the sideways separation of the slits from this center plane, over the length of the wave guide, increases stepwise, and wherein a statistic distribution of the longitudinal slits, which form the individual radiation elements, is provided with respect to the longitudinal center plane of the wave guide.

14. Furnace according to claim 13, wherein over the length of the wave guide (21) provided to feed the antenna slits (18) at least 20 individual slits are provided.

15. Furnace according to claim 14, wherein at least some of its slits run perpendicular to the direction of propagation of the microwave field in the wave guide.

16. Furnace according to claim 11, wherein for introduction of the microwave energy into the resonant cavity (16) at least two group emitters are provided.

17. Furnace according to claim 16, wherein the group emitters (14) are arranged symmetrically with regard to a significant or distinct axis of the resonant cavity.

18. Furnace according to claim 16, wherein said group emitters are provided with slit-antenna arrangement.

19. Furnace according to claim 11, wherein the corresponding antenna-arrangement (14) is arranged in a strip-shaped outer area of the resonant wall, which runs very close to the inner outer of the resonant wall.

20. Furnace according to claim 1, wherein for the adjustment of a controllable heating device (28) for achievement of equalization of the temperature profile within the resonant cavity, which maintains the temperature of the resonant walls ($16_1$ through $16_6$) at a value which corresponds to the value of the temperature-value in a central area of batch of material being sintered (12), which is sensed as actual value, and which for its part in accordance with a control program follows a specific temperature profile over time.

21. Furnace according to claim 20, wherein various wall areas ($16_1$–$16_6$) of the resonant cavity (16) are provided with associated temperature sensors ($29_1$ through $29_6$), by means of which the possibly varying resonant wall temperatures may be sensed, and that the heating device (28) includes various heater elements ($28_1$ through $28_6$) for heating the various walls being monitored, which are individually controllable.

22. Furnace according to claim 20, wherein said controllable heating device (28) is an electric resistance heater.

23. Furnace according to claim 1, wherein the heat insulating arrangement intended for heat insulation of the resonant cavity (16) against the outer surroundings of the furnace (10) is formed internal to furnace housing (36) for receiving the resonant cavity (16) and to the heating device (28), and for its part is made of graphite material with a minimally conductive outer layer.

24. Furnace according to claim 23, wherein said graphite material is graphite felt.

25. Furnace as in claim 1, wherein the uniform energy density of the microwave field is achieved by irradiating with broadband microwave energy.

26. Furnace as in claim 1, wherein the uniform energy density of the microwave field is achieved by varying the frequency of the irradiated microwave energy over time.

27. Furnace as in claim 1, wherein the resonant cavity wall is heated to the same temperature as within the material to be treated via a servo control such that the temperature of the resonant cavity wall follows the temperature of the material to be treated.

28. A furnace for the high-temperature processing of a grouping of workpieces made of materials with relatively low dielectric loss factor (tan δ), and including:

a microwave energy source for producing electromagnetic radiation in the microwave range;

a waveguide in communication with said microwave energy source for propagating microwave radiation into a resonant cavity;

a resonant cavity in communication with said waveguide and dimensioned for receiving a grouping of individual workpieces made of materials with relatively low dielectric loss factor;

a detector for detecting the temperature within said grouping of the workpieces placed in said resonant cavity;

an electric heating device for heating the resonant cavity wall(s);

means for adjusting the output of said electric heating device to thereby adjust the temperature of the resonant cavity wall(s) to correspond to the temperature within said grouping of workpieces as detected by said detector; and a thermal insulating means provided outside said resonant cavity for insulating said furnace against heat loss into the environment, wherein said microwave generator generates broadband microwave energy and/or wherein means are provided for varying the frequency of the irradiated microwave energy over time, such that a uniform energy density of the microwave field can be achieved within said resonant cavity and such that the workpieces within said grouping receive a substantially uniform high-temperature processing, and wherein the following conditions are satisfied:

a) the resonant cavity (16) and the microwave radiation source (13) are sufficiently attuned to each other, so that the relation $$\frac{V}{\lambda^3} \cdot B \geq 20$$

is satisfied, wherein V is the volume of the resonant cavity (16), λ is the wavelength of the microwave radiation and B is their band width, further the amount $V/\lambda^3$ has a value of at least 300 and the transparent dimensions $1_x$, $1_y$ and $1_z$ of the resonant cavity (16) in the coordinate directions x, y and z have a value of approximately $$\sqrt[3]{V}$$

each;

c) the heating device (28) is arranged outside of the resonant cavity (16) in the immediate vicinity of a resonant cavity wall(s), and the heat insulating envelope (38) is arranged so that it envelopes the resonant cavity (16) and the heating device (28) from the outside, and c) the resonant cavity walls ($16_1$ through $16_6$) consist of graphite or an equivalent temperature maintaining and electrically conductive material.

* * * * *